US008299877B2

(12) United States Patent
Hong et al.

(10) Patent No.: US 8,299,877 B2
(45) Date of Patent: Oct. 30, 2012

(54) RESONATOR FOR WIRELESS POWER TRANSMISSION

(75) Inventors: Young-tak Hong, Seognam-si (KR); Sang-wook Kwon, Seongnam-si (KR); Eun-seok Park, Suwon-si (KR); Won-keun Kong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 363 days.

(21) Appl. No.: 12/654,367

(22) Filed: Dec. 17, 2009

(65) Prior Publication Data

US 2010/0156570 A1 Jun. 24, 2010

(30) Foreign Application Priority Data

Dec. 18, 2008 (KR) ..... 10-2008-0129347

(51) Int. Cl.
*H01P 7/08* (2006.01)

(52) U.S. Cl. ..... 333/219; 333/219.2

(58) Field of Classification Search ..... 333/204, 333/219, 219.1, 219.2; 307/104
See application file for complete search history.

(56) References Cited

U.S. PATENT DOCUMENTS

| | | | | |
|---|---|---|---|---|
| 4,264,881 | A * | 4/1981 | De Ronde | 333/110 |
| 5,621,366 | A * | 4/1997 | Gu et al. | 333/204 |
| 5,629,266 | A | 5/1997 | Lithgow et al. | |
| 6,600,451 | B2 | 7/2003 | Mimura et al. | |
| 6,933,812 | B2 | 8/2005 | Sarabandi et al. | |
| 7,579,836 | B2 * | 8/2009 | Schnell et al. | 324/318 |
| 7,855,694 | B2 * | 12/2010 | Watanabe | 343/842 |
| 2005/0275593 | A1 | 12/2005 | Maslovski et al. | |
| 2008/0165079 | A1 | 7/2008 | Smith et al. | |

FOREIGN PATENT DOCUMENTS

JP 2002-246816 8/2002

OTHER PUBLICATIONS

Kang et al., "Magnetically tunable negative permeability metamaterial composed by split ring resonators and ferrite rods", Optics Express, vol. 16, No. 12, Jun. 2, 2008, pp. 8825-8834.*

* cited by examiner

*Primary Examiner* — Seungsook Ham
(74) *Attorney, Agent, or Firm* — NSIP Law

(57) ABSTRACT

Disclosed is a resonator for wireless power transmission used in a mobile device. The resonator includes a substrate, at least one microstrip line, and a magnetic core. The microstrip line is formed on the substrate and is provided at one side thereof with a slit to have an open-loop shape. The magnetic core is formed on the substrate and is disposed on a space defined by the microstrip line to increase coupling strength.

20 Claims, 2 Drawing Sheets

RESONATOR FOR WIRELESS POWER TRANSMISSION

CROSS-REFERENCE TO RELATED APPLICATIONS

This application claims the benefit under 35 U.S.C. §119 (a) of Korean Patent Application No. 10-2008-0129347, filed on Dec. 18, 2008, the disclosure of which is incorporated herein in its entirety by reference.

BACKGROUND

1. Field

One or more embodiments relate to a resonator, and more particularly, to a resonator for wireless power transmission, which is applicable to mobile devices.

2. Description of the Related Art

With the development of information technology, various kinds of mobile devices have been developed and put on the market, and the majority of people generally own various kinds of mobile devices. Since such mobile devices may have interfaces which vary according to supply power or charging system, the mobile devices need to have power suppliers and chargers satisfying the standards of the relevant mobile device.

In order to avoid any inconvenience, recently, a large amount of research has been pursued in the fields of wireless power transmission technologies capable of supplying power to devices "remotely". If the wireless power transmission technology is commercialized, power can be supplied, in a simple manner, to the mobile devices regardless of their location. In addition, the commercialization of the wireless power transmission technology allows for a reduction in the waste from batteries. As a result, environmental pollution can be reduced.

As an example of wireless power transmission, a technology has been looked into which is capable of transmitting high power over a short distance without having to use wires by employing electromagnetic resonance based on evanescent wave coupling. However, this technology is realized by using a near field at low frequency to transmit power over a short distance, and as such the size of a necessary resonator is increased.

SUMMARY

Accordingly, in one aspect, there is provided a resonator for wireless power transmission, which can be provided with a small size, and which can increase the transmission distance for wireless power transmission and enhance the transmission efficiency in wireless power transmission.

In one aspect, there is provided a resonator for wireless power transmission including a substrate, at least one microstrip line formed on the substrate, the at least one microstrip line being provided with one side having a slit to form an open-loop shape of the at least one microstrip line, and a magnetic core formed on the substrate and disposed within a space defined by the at least one microstrip line to increase coupling strength.

Other features will become apparent to those skilled in the art from the following detailed description, which, taken in conjunction with the attached drawings, discloses embodiments of the invention.

BRIEF DESCRIPTION OF THE DRAWINGS

These and/or other aspects and advantages will become apparent and more readily appreciated from the following description of the embodiments, taken in conjunction with the accompanying drawings of which.

DETAILED DESCRIPTION

Figure 1:
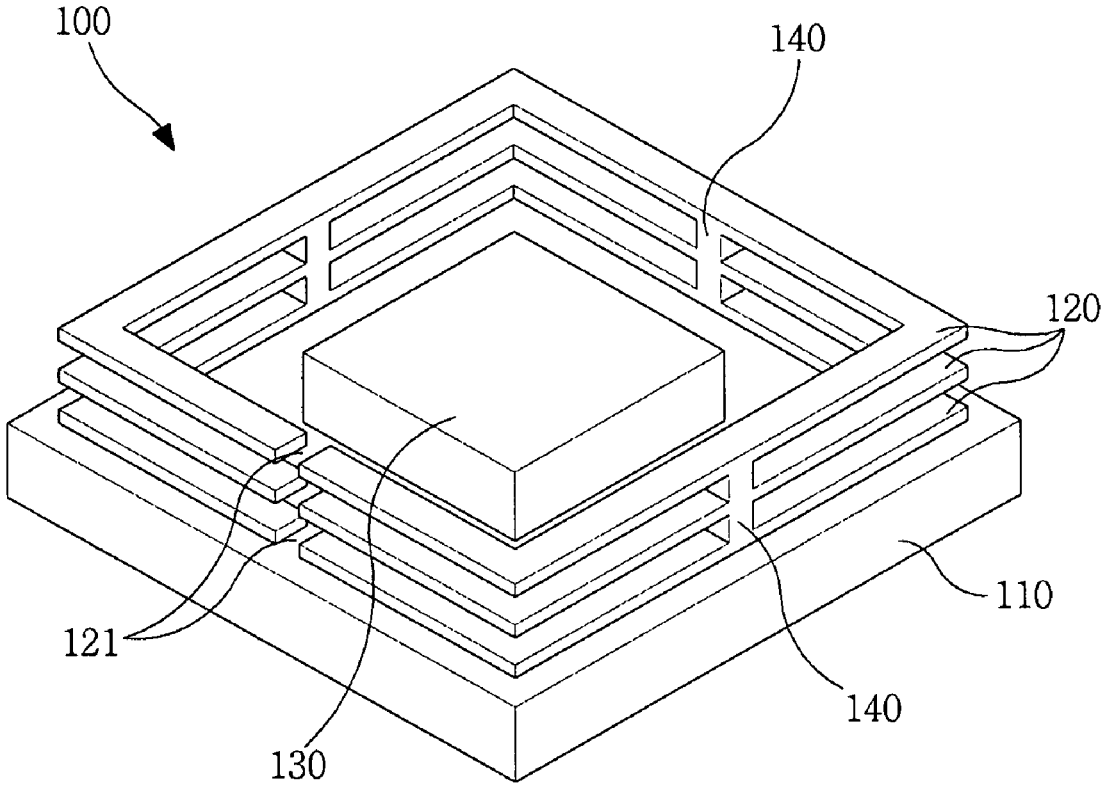
FIG. 1 is a perspective view illustrating a resonator for wireless power transmission, according to one or more embodiments.

Reference will now be made in detail to embodiments, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

Figure 2:
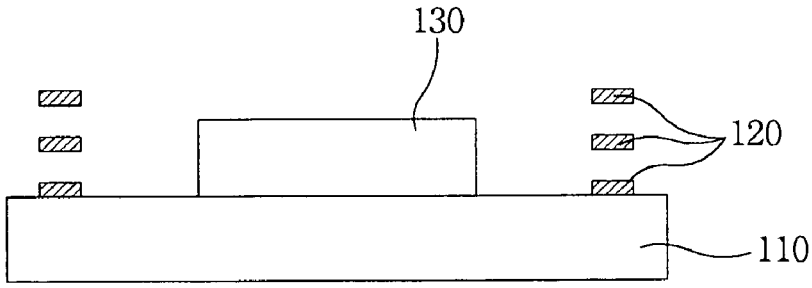
FIG. 2 is a sectional view illustrating a resonator, such as the resonator of FIG. 1, according to one or more embodiments.

FIG. 1 is a perspective view illustrating a resonator for wireless power transmission, and FIG. 2 is a sectional view illustrating a resonator, such as the resonator of FIG. 1. Resonators for wireless power transmission are provided on a wireless power transmission apparatus and a mobile device, respectively such that power is supplied to the mobile device through a magnetic field based on resonance coupling.

As shown in FIGS. 1 and 2, the resonator 100 for wireless power transmission includes a substrate 110, at least one microstrip line 120, and a magnetic core 130.

The microstrip line 120 and the magnetic core 130 are formed on an upper surface of the substrate 110 and supported by the substrate 110. The substrate 110 is formed of a dielectric substance. In this case, the substrate 110 is provided in a desired size by adjusting a dielectric constant of the dielectric substance forming the substrate 110 at a fixed resonance frequency. For example, if the substrate 110 is required to have a small size, the substrate 110 is formed using dielectric substance having a high dielectric constant.

If current is applied to the microstrip line 120, a near field is formed around the microstrip line 120. The microstrip line 120 is provided at one side thereof with a slit 121, forming an open-loop shape. The microstrip line 120 is provided in the form of a rectangular open loop. The microstrip line may be provided in the form of a circular open loop. The microstrip line 120 is formed of an electrically conducting substance having an electric conductivity.

The magnetic core 130 is formed on the substrate 110. The magnetic core 130 is disposed on a space defined by the microstrip line 120. The magnetic core 130 is disposed without making contact with the microstrip line 120. The magnetic core 130 traps an electric field inside the substrate 110 and increases the intensity of a magnetic field, so that the coupling strength of resonance is increased. Accordingly, even if the resonator 100 is provided with a small size, the transmission efficiency of power is enhanced.

The intensity of a magnetic field is in proportion to a relative permeability. If a magnetic core is not disposed in the space defined by the microstrip lines 120, the relative permeability has a value of about 1. If the magnetic core 130 is disposed in the space defined by the microstrip lines 120, the relative permeability has a value of over 100. Accordingly, the magnetic core 130 allows the intensity of the magnetic field to be increased, thereby increasing the coupling strength.

As expressed in Equation 1 below, if coupling strength of the resonance coupling is increased, transmission efficiency of energy is enhanced. K represents a coupling strength of the resonance coupling, Γ corresponds to 1/Q, and Q indicates a susceptibility with respect to a resonance.

Equation 1:

$$\text{Transmission efficiency } \eta = K/\Gamma$$

As shown in Equation 1, as the coupling strength is increased due to the magnetic core 130, transmission efficiency of power is enhanced in the resonator 100, and thus a transmission distance of the wireless power transmission is increased.

In addition, the magnetic core 130 allows the resonance frequency to remarkably shift into a low frequency range. Accordingly, the resonator 100 has a reduced size at a fixed resonance frequency. That is, a compact resonator 100 is realized.

The magnetic core 130 may be a ferrite magnetic core. Characteristics of ferrite allow the electric field to be efficiently trapped in the substrate 110 and allow the intensity of the magnetic field to be increased, so that the transmission efficiency of power is further enhanced and the transmission distance of the wireless power transmission is further increased.

Meanwhile, the microstrip lines 120 may be provided in plural. The microstrip lines 120 are coaxially stacked on the substrate 110 while being separated from each other forming a three-dimension structure. As a result, the area required to install the resonator 100 is reduced such that the resonance frequency is shifted in a low frequency range.

That is, as the number of the microstrip lines 120 is increased, the resonance frequency is lowered. If microstrip lines are arranged in a two dimensional structure, the area of a substrate needs to be increased in proportion to the number of the microstrip lines.

However, even if the number of the microstrip lines 120, which are arranged in a three dimensional structure, is increased, the substrate 110 does not need to be increased. Accordingly, the installation area of the resonator 100 can be provided with a small size while lowering the resonance frequency.

As described above, if the resonance frequency is set in a low frequency range, a short distance power transmission using near field is effectively achieved. The size of the microstrip lines 120 in addition to the number of the microstrip lines 120 may be adjusted to be suitable for a desired frequency range.

A gap between the microstrip lines 120 may be set to be suitable for a desired coupling strength. As the gap between the microstrip lines 120 is decreased, the coupling strength is increased. That is, if the microstrip lines 120 have a small gap therebetween, power transmission over a short distance is more effectively achieved.

The microstrip lines 120 form a stacked structure, and such a stacked structure is suitable for a Micro Electro Mechanical System (MEMS) process. In this manner, the microstrip lines 120 are disposed close to each other, and the coupling strength is effectively increased.

The microstrip lines 120 are supported by a plurality of columns 140 while being separated from each other. Accordingly, a predetermined gap is maintained between the microstrip lines 120. If the microstrip lines 120 have a rectangular open-loop shape, the columns 140 are disposed on at least three of four edges of the microstrip lines 120 such that the microstrip lines 120 are stably supported while maintaining a gap therebetween.

If the microstrip lines 120 are formed of an electrically conducting substance, the columns 140 may be formed of a dielectric substance or an electrically conducting substance. If the columns 140 are formed of an electrically conducting substance, electricity passes through all of the microstrip lines 120.

Figure 3:
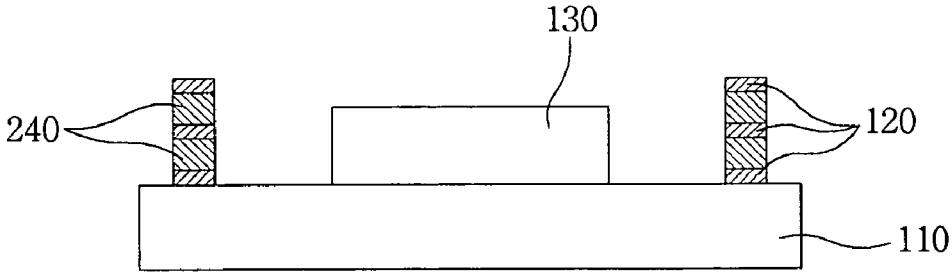
FIG. 3 is a sectional view illustrating a resonator, in which microstrip lines are supported by a support layer, according to one or more embodiments.

According to a resonator, as shown in FIG. 3, the microstrip lines 120 may be supported by a support layer 240 while being separated from each other. In this manner, a predetermined gap is maintained between the microstrip lines 120. If the microstrip lines 120 have a rectangular open-loop shape, the support layer 240 also has a rectangular loop shape.

The support layer 240 has the same width as the microstrip line 120. However, the support layer 240 may have a width smaller than that of the microstrip line 120 as long as the support layer 240 supports the microstrip lines 120, and the width of the support layer 240 is not limited thereto. The support layer 240 may be formed of a dielectric layer.

While aspects of the present invention has been particularly shown and described with reference to differing embodiments thereof, it should be understood that these exemplary embodiments should be considered in a descriptive sense only and not for purposes of limitation. Descriptions of features or aspects within each embodiment should typically be considered as available for other similar features or aspects in the remaining embodiments.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A resonator for wireless power transmission, the resonator comprising:

a substrate;

at least one microstrip line formed on the substrate, the at least one microstrip line being provided with one side having a slit to form an open-loop shape of the at least one microstrip line; and a magnetic core formed on the substrate and enclosed by the open-loop shape of the at least one microstrip line to increase coupling strength.

2. The resonator of claim 1, wherein the at least one microstrip line includes a plurality of microstrip lines, with the plurality of microstrip lines being coaxially stacked on the substrate and separated from each other.

3. The resonator of claim 2, wherein the plurality of microstrip lines are supported by a plurality of columns formed between the plurality of microstrip lines to maintain a predetermined gap between the plurality of microstrip lines.

4. The resonator of claim 3, wherein the substrate is formed of a dielectric substance, the plurality of microstrip lines are formed of an electrically conducting substance, and the columns are made of a dielectric substance.

5. The resonator of claim 3, wherein the substrate is formed of a dielectric substance, the plurality of microstrip lines are formed of an electrically conducting substance, and the columns are made of an electrically conducting substance.

6. The resonator of claim 2, wherein the plurality of microstrip lines are supported by a support layer formed between the plurality of microstrip lines to maintain a predetermined gap between the plurality of microstrip lines.

7. The resonator of claim 5, wherein the substrate is made of a dielectric substance, the plurality of microstrip lines are made of an electrically conducting substance, and the support layer is made of a dielectric substance.

8. The resonator of claim 2, wherein a size and a number of the plurality of microstrip lines are set to be suitable for resonance coupling through a desired frequency range.

9. The resonator of claim 2, wherein gaps between the plurality of microstrip lines are set to obtain a desired coupling strength.

10. The resonator of claim 1, wherein the at least one microstrip line has a rectangular open-loop shape.

11. The resonator of claim 1, wherein the at least one microstrip line has a circular open-loop shape.

12. The resonator of claim 1, wherein the magnetic core is disposed without making contact with the at least one microstrip line.

13. The resonator of claim 1, wherein the magnetic core is disposed entirely within the space defined by the at least one microstrip line.

14. The resonator of claim 6, wherein the support layer has a same width or a smaller width than the plurality of microstrip lines.

15. A resonator for wireless power transmission, comprising:

a strip line formed on a substrate and comprising one side having a slit to form an open-loop shape of the at least one strip line; and a magnetic core formed on the substrate and enclosed by the open-loop shape of the strip line to increase coupling strength.

16. The resonator of claim 15, wherein the strip line comprises a plurality of strip lines coaxially stacked on the substrate and separated from each other.

17. The resonator of claim 16, wherein the plurality of strip lines are supported by columns formed between the plurality of strip lines to maintain a predetermined gap between the plurality of strip lines.

18. The resonator of claim 15, wherein the magnetic core is disposed without making contact with the strip line.

19. The resonator of claim 16, wherein the plurality of strip lines are supported by a support layer formed between the plurality of strip lines to maintain a predetermined gap between the plurality of strip lines.

20. The resonator of claim 19, wherein the support layer has a same width or a smaller width than the plurality of strip lines.

* * * * *